US005946855A

United States Patent [19]

Miconi

[11] Patent Number: 5,946,855

[45] Date of Patent: Sep. 7, 1999

[54] SWING-AWAY PET DOOR APPARATUS

[75] Inventor: Frank G. Miconi, 5290 Rio Plata Dr., Oceanside, Calif. 92057

[73] Assignee: Frank G. Miconi, Ocean Side, Calif.

[21] Appl. No.: 08/941,547

[22] Filed: Sep. 30, 1997

[51] Int. Cl.[6] ..... E05D 15/48

[52] U.S. Cl. ..... 49/163; 49/168; 160/180

[58] Field of Search ..... 49/168, 169, 163; 160/180, 181, 100, 182

[56] References Cited

U.S. PATENT DOCUMENTS

| | | | |
|---|---|---|---|
| 2,606,607 | 8/1952 | Vita | 160/100 |
| 2,624,403 | 1/1953 | Zelenko | 160/100 |
| 3,464,158 | 9/1969 | Greene | 160/180 |
| 3,690,299 | 9/1972 | Johnson | 49/169 |
| 3,811,224 | 5/1974 | Garrison | 49/168 |
| 3,874,118 | 4/1975 | Robinson | 49/169 |
| 3,878,645 | 4/1975 | Porter | 49/169 |
| 3,884,192 | 5/1975 | Knapp | 119/159 |
| 3,911,990 | 10/1975 | Hoover et al. | 160/100 |
| 4,053,007 | 10/1977 | Griffith | 49/168 |
| 4,126,104 | 11/1978 | Overby | 119/159 |
| 4,322,913 | 4/1982 | Himmer | 49/168 |
| 4,497,133 | 2/1985 | Blenkinsop | 49/169 |
| 4,580,529 | 4/1986 | Wilson | 119/159 |
| 4,754,797 | 7/1988 | Sronce | 49/169 |
| 5,072,544 | 12/1991 | Breck, Jr. | 49/168 |
| 5,185,954 | 2/1993 | Waddle, Sr. | 49/169 |
| 5,551,188 | 9/1996 | Davlantes | 49/169 |
| 5,701,702 | 12/1997 | Reid et al. | 49/169 |

*Primary Examiner*—Daniel P. Stodola
*Assistant Examiner*—Curtis A. Cohen
*Attorney, Agent, or Firm*—Rodger Flagg

[57] ABSTRACT

The swing-away pet door apparatus, is adapted for mounting to the frame of a new or existing conventional sliding glass door assembly. A hinge member is secured to an elastomeric sealing flange, which is secured to the sliding glass door frame at a location adjacent to the sliding glass door. The hinge mounted to the elastomeric sealing flange positions the swing-away frame member between open and closed positions. In the open position, the swing-away frame member is positioned adjacent to the door frame and clear of the door frame tracks, providing substantially full access through the sliding glass door frame, when the sliding glass door is opened. The sliding glass door may also be completely closed and locked when the hinge member is in the open position. When the swing-away frame member is moved into a closed position parallel to the sliding glass door tracks, the sliding glass door or the sliding screen door may be slidably positioned in the door frame tracks to provide a partial access opening, or closed to abut the swing-away frame member. The sliding glass door may also be locked to the swing-away frame member. When the swing-away frame member is closed, the pet access door provides ingress and egress to a pet through the pet access door.

26 Claims, 7 Drawing Sheets

SWING-AWAY PET DOOR APPARATUS

BACKGROUND OF THE INVENTION

The present invention relates to a swing-away pet door apparatus for use with a new or existing sliding glass door assembly. The pet door apparatus has a swing-away frame member which is hingedly connected to the door frame. A pet access door is mounted within the swing-away frame. The swing-away pet door apparatus provides ingress and egress through the pet door when the swing-away frame is positioned to abut the sliding glass door frame. For human egress and ingress, the swing-away pet door apparatus is hingedly rotated adjacent to the door frame between open and closed positions. In the open position, substantially full access is provided through the door frame when the sliding glass door is opened in a conventional manner, while allowing the sliding glass door to fully close and lock when the swing away frame is rotated out of the way. When the swing-away pet door frame is positioned to abut the sliding glass door frame, the swing-away pet door apparatus is accessible to the pet for ingress and egress.

DESCRIPTION OF THE RELATED ART

U.S. Pat. No. 5,185,954 issuing to Richard Waddle Sr. on Feb. 16, 1993 discloses a pet portal device, wherein a panel having a pet access door is hingedly connected to the glass portion of the sliding glass door. Waddle's pet portal device requires the user to slide both the sliding glass door and the panel having a pet access door each time a human passes through the portal. This provides extra stress on the sliding glass door, and increases the effort required to open and close the sliding glass door, which can be a problem for the handicapped or the elderly. In contrast, applicant's invention provides advantages and unexpected results by hingedly connecting his swing away frame member to an elastomeric sealing flange member secured to the sliding glass door frame, allowing the sliding glass door to open and close independently of the swing away frame member while providing substantially full access through the sliding glass door when the swing away frame member is rotated away from the sliding glass door opening.

U.S. Pat. No. 3,878,645 issuing to Robert Porter on Apr. 22, 1975 discloses a pet door device for mounting in a sliding glass door frame, wherein an upper portion is hingedly connected to a lower portion. Human access through the sliding glass door is limited by the size of the pet door device.

U.S. Pat. No. 5,105,868 issuing to Sharron Riise on Apr. 21, 1992 discloses a sliding door security screen which does not have a pet access door mounted therein. A second embodiment, shown in FIG. 5 and FIG. 6, discloses a screen having a top portion hingedly connected to a bottom portion for ease of storage between use.

U.S. Pat. No. 3,811,224 issuing to Elbert Garrison on May 21, 1974 discloses a pet door panel which is installed or removed from a conventional sliding glass door frame with a minimum effort.

U.S. Pat. Nos. 3,654,733 and 4,322,913 are representative of other pet doors found in the prior art.

SUMMARY OF THE INVENTION

The swing-away pet door apparatus disclosed herein, is adapted for mounting to the frame of a new or existing conventional sliding glass door assembly. A hinge member is secured to an elastomeric sealing flange member, which in turn is secured to the sliding glass door frame at a location adjacent to the sliding glass door. The elastomeric sealing flange member is connected by a hinge member to the swing-away frame member, allowing the swing away frame member to move between open and closed positions.

In the open position, the swing-away frame member is positioned adjacent to the door frame and clear of the sliding door frame tracks, providing substantially full access through the sliding glass door frame, when the sliding glass door is opened. The sliding glass door may also be completely closed and locked when the hinge member is in the open position.

When the swing-away frame member is moved into a closed position parallel to the sliding glass door tracks, the sliding glass door may be slidably positioned in the door frame tracks to provide a partial access opening, or closed to abut the swing-away frame member. When the swing-away frame member is moved into a closed position parallel to the sliding glass door tracks with the sliding glass door fully opened, the screen door may be closed to abut the swing-away frame, which is a feature no other pet door provides. The sliding glass door may also be locked to the swing-away frame member. When the swing-away frame member is closed, the pet access door provides ingress and egress to a pet through the pet access door.

A more complete appreciation of the present invention and its scope may be obtained from understanding the accompanying drawings and the following detailed description of a preferred embodiment of the invention. The drawings are briefly summarized below.

DETAILED DESCRIPTION OF A PREFERRED EMBODIMENT OF INVENTION

Figure 1:
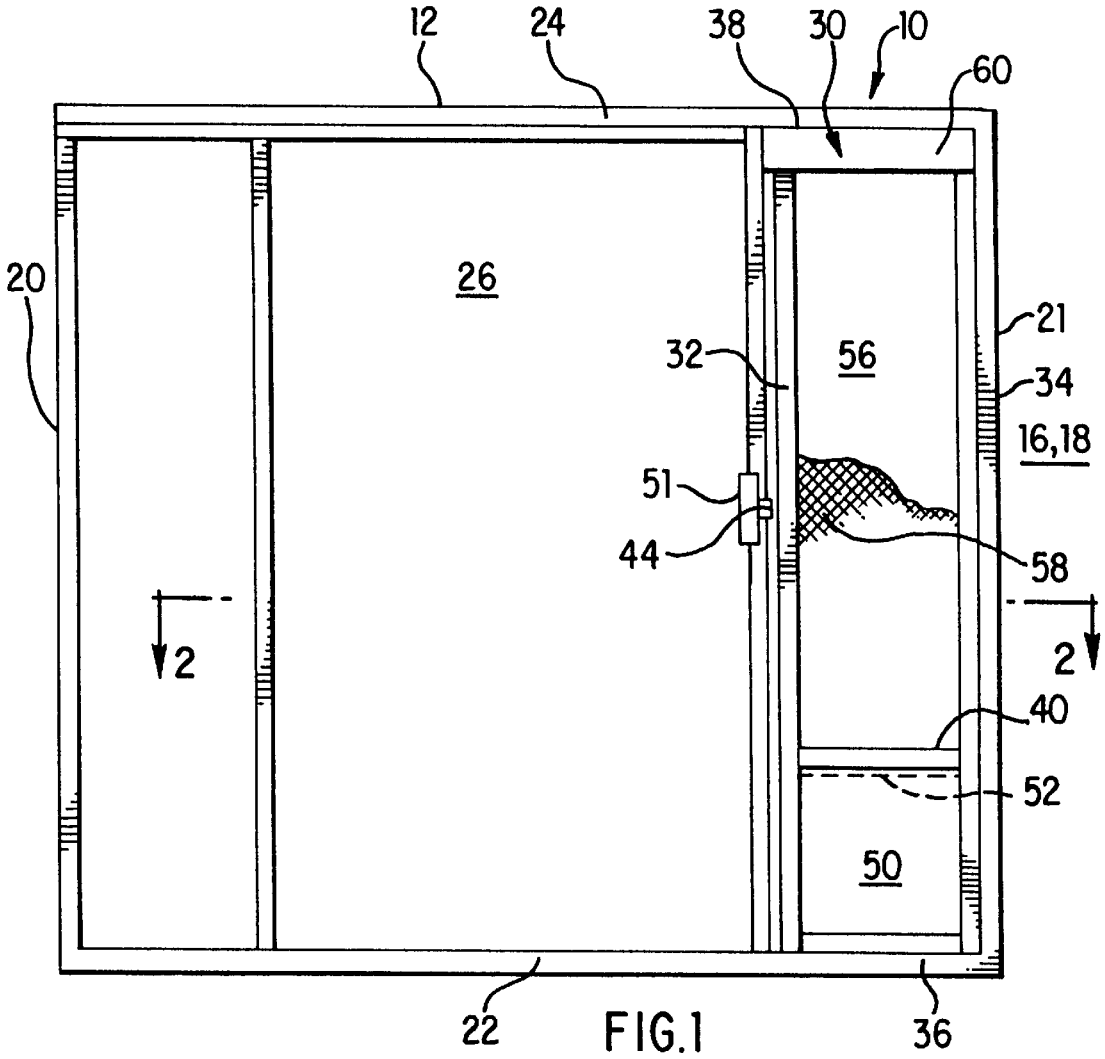
FIG. 1 is a front elevational view of the swing-away pet door apparatus mounted in a closed position adjacent to a sliding glass door, providing partial access through the sliding glass door when the sliding glass door is moved to an open position.

As shown in FIG. 1–17, the swing-away pet door apparatus 10, is connected by a hinge means 42 to a conventional sliding door frame 12. The sliding door frame 12 is typically secured by conventional securing means (not shown), such as nails or screws, to a building structure 18, such as a home or office.

The sliding door frame 12 typically has opposing upright portions comprising a first upright portion 20 and a second upright portion 21. The sliding door frame 12 also has a lower track portion 22 and an upper track portion 24. The lower track portion 22 slidably receives at least one sliding door member 26 therein. Some sliding door assemblies comprise a sliding glass door member, while other sliding door assemblies may be in the form of a solid or composite door member, and the sliding door assembly may also include a sliding screen door portion 28. A complimentary upper track portion 24 is typically positioned on the upper side of the sliding glass door frame 12, in alignment with the lower track portion 22, enabling the sliding door member 26 to be slidably moved between open and closed positions within the sliding door frame 12.

Typically, the sliding door member 26 is opened to provide ingress and egress through approximately one half of the opening between the opposing upright portions 20 of the sliding door frame 12. A sliding screen 28 is often positioned in offset parallel alignment with the sliding door member 26. In the closed position, the sliding door member 26 is moved to close the opening by abutting the sliding door member 26 against the second upright portion 21 of the sliding door frame 12. Alternately, the sliding screen portion 28 may be moved to close the opening. A locking means 44 is often provided to secure the sliding door member 26 to the second side 21 of the sliding door frame 12, in the closed position.

The prior art discloses the use of a pet door 50 which attaches by a hinge directly to a sliding glass door 26. The weight of the swing-away frame member 30 must be carried with the sliding glass door 26, as the sliding glass door 26 is opened and closed. This makes the opening and the closing of the sliding glass door 26 more difficult, due to the increased bulk and the increased weight. Further, when the pet door 50 is mounted directly to the sliding glass door 26, the sliding glass door 26 cannot be locked in the closed position by the conventional locking means 44 provided upon the sliding glass door frame 12.

Applicants invention overcomes these disadvantages, and provides advantages and unexpected results not taught in the prior art. The pet door frame 12 is mounted with a hinge means 42 to an elastomeric sealing flange 46, which is secured to one of the first or second side 21 of the sliding door frame 12. When secured to the elastomeric sealing flange 46 by a suitable hinge means 42, the swing-away frame 30 may be pivoted out of the way, providing substantially full access between the opened sliding door 26 and the sliding door frame 12, when desired. The swing-away pet door apparatus 10 may be adapted to either swing within or without the building structure 18, to suit the user, or to suit existing door configurations.

The swing-away frame member 30 may be pivoted about the hinge means 42 up to 90 degrees or even 180 degrees where a multi-positioned hinge means 42 is used, to provide substantially full access therethrough. The pivoting swing-away frame 30 also allows the sliding door 26 to entirely close and lock with the conventional sliding glass door locking means 44, improving security when the users of the apparatus are away, or during periods of increased security, such as at night, when the swing-away pet door apparatus 10 is not usually needed.

When the swing away-frame member 30 is pivoted into position in alignment with the sliding door 26, and the sliding door 26 is positioned to abut the swing-away frame member 30, the pet door 50 may be utilized without moving the sliding door 26. To increase security, the sliding door 26 may be adapted for securement to the swing-away frame member 30 by any conventional locking means 44.

As best shown in FIG. 1, the sliding door frame 12, is secured about an aperture 14 in a wall portion 16 of a building structure 18, such as a home, office, etc. The sliding door frame 12 typically has opposing upright portions comprising a first upright portion 20 and a second upright portion 21, a lower track portion 22, an upper track portion 24, and at least one cross brace 40.

One or more sliding door members 26 are slidably received between the lower track portion 22 and the upper track portion 24. A sliding screen 28 may also be positioned in offset parallel alignment to the sliding door member 26. When the sliding door 26 is moved to the open position, partial egress and ingress is possible between the swing-away frame member 30 and the sliding door members 24. When the sliding door member 26 is moved to the closed position, the sliding door member 26 abuts the swing-away frame member 30, restricting access through the sliding door member 26, while providing egress and ingress for pets through the pet door 50.

Figure 2:
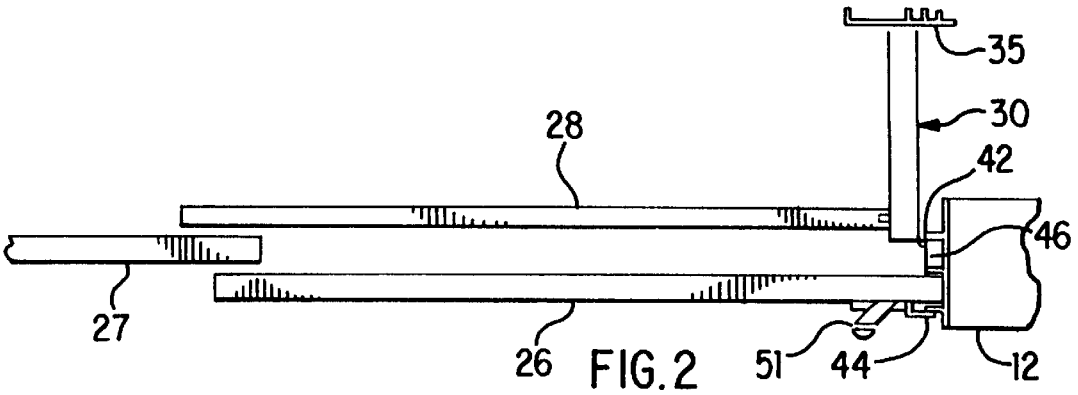
FIG. 2 is a cut-away view taken along lines 2—2 in FIG. 1, showing the swing-away pet door pivoted out of the way, with the sliding glass door closed and locked, and the screen door in closed position.
Figure 3:
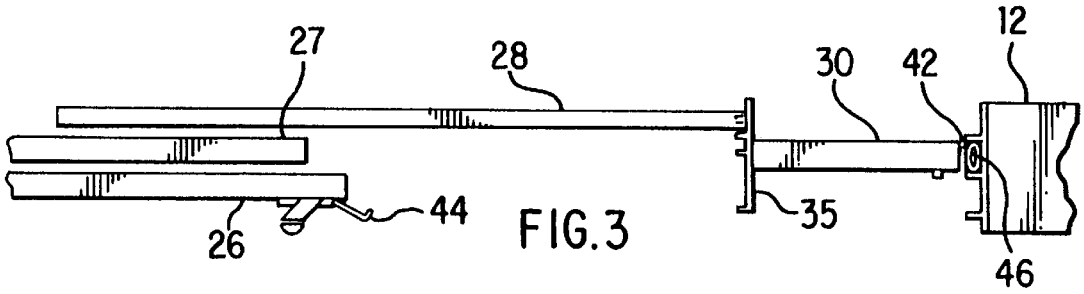
FIG. 3 is a cut-away view taken along lines 2—2 in FIG. 1, showing the swing-away pet door positioned for ingress and egress by a pet through the swing-away pet door, with the screen door in a closed position, abutted against the swing-away pet door.

An elastomeric sealing flange 46 is secured on a first side to either the first or second upright portion 20 or 21 of the sliding door frame 12, depending upon the left or right side opening position of the sliding door 26. The elastomeric sealing flange 46 is preferably offset from the upper and lower track portions 22, 24, allowing the sliding door 26 to be fully closed and secured by conventional locking means 44 when the swing-away frame member 30 is pivoted about the hinge means 42 out of engagement with the sliding door 26, as best shown in FIG. 2.

The elastomeric sealing flange 46 is secured on a second side to a hinge means 42. The hinge means is also secured to the swing-away frame member 30, so that the swing-away frame member 30 may be pivoted about the hinge means 42 between open and closed positions. Any known hinge means 42 may be utilized without departing from the scope of this disclosure, or from the following claims. Multi-position hinge means 42 may be used to extend the reach and rotational movement of the swing-away pet door apparatus 10 beyond 90 degrees to suit user preference.

Figure 4:
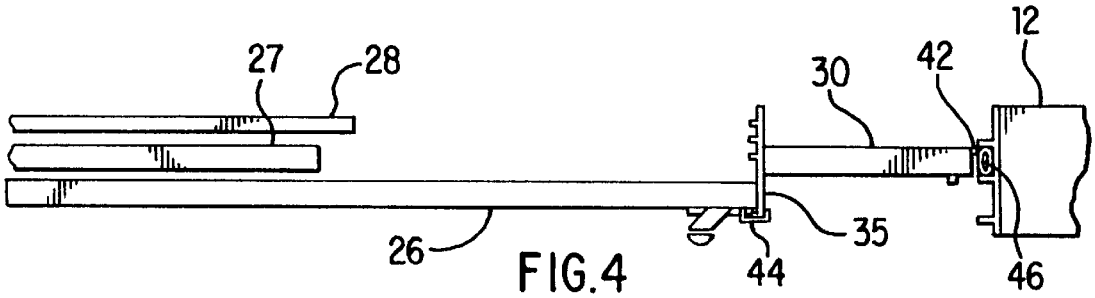
FIG. 4 is a cut-away view taken along lines 2—2 in FIG. 1, showing the swing away pet door apparatus in a closed position adjacent and off-set with the sliding glass door.

In the closed position, as shown in FIG. 4, the swing-away frame member 30 is aligned to abut the sliding door 26, when the sliding door 26 is slidably moved into a closed position adjacent to the swing-away frame member 30. The swing-away frame member 30 may be adapted to abut the sliding door 26 in offset alignment, without departing from the scope of this disclosure, or from the following claims.

A door stop face plate 35 may be provided to abut the sliding door 26, when the swing-away frame member 30 is in the closed position. The door stop face plate 35 may extend to also provide a stop for the sliding screen 28, as shown in FIG. 2.

A suitable locking means 44 may be provided to secure the sliding door 36 to the door stop mounted upon the swing-away frame member 30. The swing-away fame member 30 comprises a first upright side 32, a second upright side 34, a lower side 36 and an upper side 38. One or more cross braces 40 may be adapted to extend between the first upright side 32 and the second upright side 34 to strengthen the swing away frame member 30. At least one cross brace 40 is preferably positioned between the first and second upright sides 32, 34. to support the upper portion of the pet door 50.

The pet door 50 may be secured to a cross brace 40 or to one of the first or second upright sides 32, 34, by a suitable pet door hinge means 52. Alternately, the pet door 50 may be fabricated of a flexible material, such as rubber or plastic, which will bend between open and closed positions. Preferably, the pet door 50 remains closed between use, and is biased open by the pet as the pet passes through the pet door 50, and closes once the pet has passed through the pet door 50.

The pet door 50 may be fabricated in several sizes to suit various sizes of pets, such as small, medium and large size pets. By way of an example embodiment, the pet door 50 may be selected from a range of from five inches in width to twelve inches in width, and from eight inches in height to eighteen inches in height. The pet door 50 is preferably configured to be rectangular in shape, however other shapes, such as round, oval, oblong, or multi-sided may be adapted for use with this invention, without departing from the scope of this disclosure, or from the accompanying claims.

The swing away frame member 30 is sized to receive the pet door 50 between the first and second upright sides 34, 36, and between the lower side 36 and a cross brace 40 of the swing-away frame member 30. The pet door 50 may alternately be configured to be secured to one of the first and second upright sides 34, 36, the cross brace 40 or the lower side 36, to suit manufacturing or user preference. Preferably, the pet door 50 is secured to the cross brace 40, and may be biased into an open position from either side of the pet door 50 by a pet as the pet passes through the pet door 50.

Figure 12:
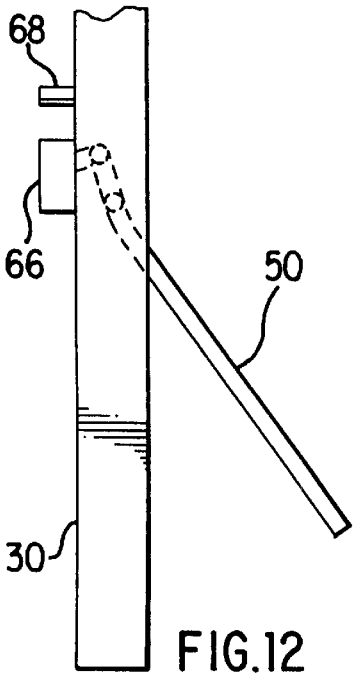
FIG. 12 is a perspective view of the pet door, wherein a battery powered infra-red or optical sensor is utalized to selectively raise and lower the pet door.

Alternately, the pet door 50 may be adapted with a suitable motor 66 which is actuated by a suitable sensing means 68, such as an infra-red, optical or motion sensor, as shown in FIG. 12. The pet door 50 may be adapted to raise and lower in vertical alignment, to pivot from the top or from one side, to slide in side-to-side relation, or to open and close from opposing sides, to suit manufacturing or user preference, without departing from the scope of this disclosure, or from the following claims. Weights 54, counter weights, or pivot means may also be used to aid in opening and closing the pet door 50.

The pet door 50 may also be made of a flexible material, and selectively rolled up on a suitable spindle(s) 48 to open the pet door 50, and unrolled to close the pet door 50. The spindle(s) 48 may be located on the top, or on either or both sides, depending upon the type of pet door 50 closure desired.

Figure 15:
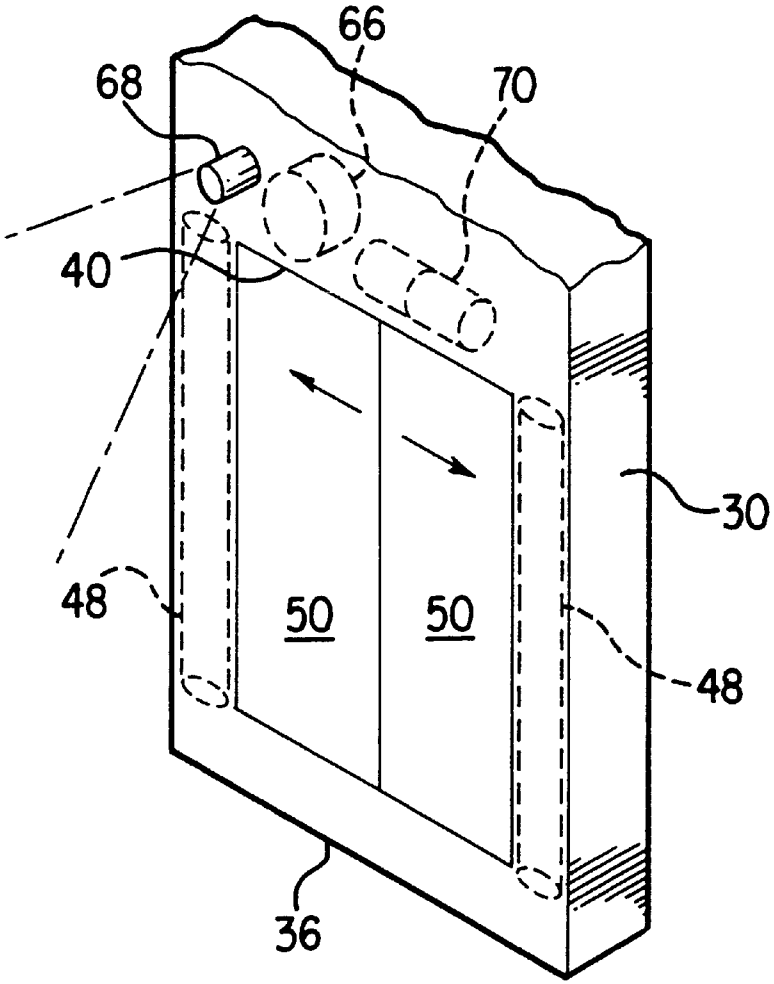
FIG. 15 is a detail view of the pet door adapted with a spring loaded door shutter responsive to an infra-red or optical sensor.

The motor 66 may be wired into the alternating house current by any conventional means, or may be adapted to be a D.C. motor 66, actuated by batteries 70, as shown in FIG. 15.

Figure 14:
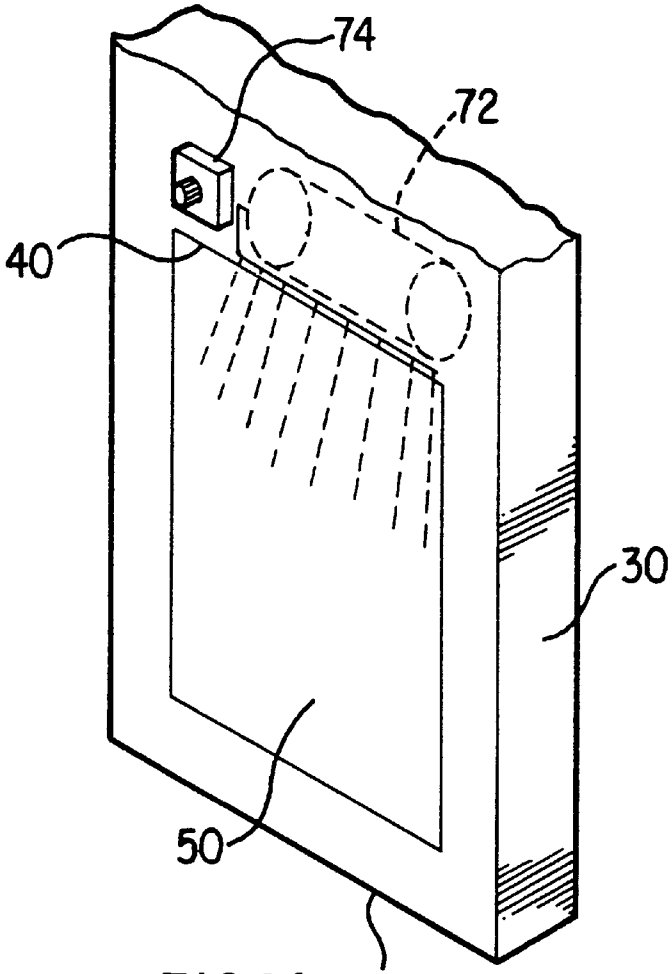
FIG. 14 is a detail view of the pet door, wherein a flea spray is actuated by a timer or cycle control unit as the pet passes through the pet door.

The door stop face plate 35 may be configured as shown in FIG. 14 to be adjustably positioned on the swing-away frame member 30. A door stop face plate extension 64 may be used to adjust the height of the door stop face plate 35 to suit existing sliding door frame 12 heights.

A suitable glass or plastic window 56 is preferably provided between one of the cross braces 40 supporting the pet door 50 and the upper side 38, and between the first and second upright sides 32, 34. The window may be secured to the swing-away frame member 30 by any conventional means. The window 56 may include a fixed and/or a movable portion (not shown), as is well known in the art, to selectively provide passage of air through the opening provided by the movable window 56 portion. Where a movable window 56 portion is used, the window 56 portion preferably also includes a screened portion 57 covering the movable window 56 portion, to keep bugs from passing into the structure 18 through the opened window 56. Fixed and movable window 56 portions, as well as movable and fixed screen portions 57 are commercially available in a wide variety of sizes and styles, and their use and installation is well known in the art, and thus are not further detailed herein. Preferably, the window 56 material is made of safety glass. Transparent, translucent or opaque decorative panels or stained glass panels may also be installed in place of conventional glass or screen inserts, to suit user preference.

Alternately, the swing-away frame member 30, located between the cross brace(s) 40 and the first and second upright sides 32, 34 and the upper side 38 may be enclosed by any conventional building material, to compliment or contrast with the existing building structure 18.

Insulation (not shown) may also be used within swing-away frame member 30 to suit local environmental conditions at the site of the structure 18. The use of conventional building material and insulation is well known in the art, and thus is not further detailed herein.

To install the swing-away pet door apparatus 10 disclosed herein, the user secures the elastomeric sealing flange 46 to either the first or second upright portions 20, 21 of the sliding door frame 12, or to the wall portion 16 adjacent to the first or second upright portions 20, 21. When viewed from outside the structure 18, the elastomeric sealing flange 46 is mounted to the first upright portion 20, when the sliding door 26 is closed on the left side, and the elastomeric sealing flange 46 is mounted to the second upright portion 21, when the sliding door 26 is closed on the right side. The elastomeric sealing flange 46 is preferably adhesively secured on a first side to the door frame 12, and on a second side to the frame hinge means 42.

The swing-away frame member 30 is mounted by a suitable frame hinge means 42 to the elastomeric sealing flange 46, so that the swing-away frame member 30 is pivotally movable between an open position which allows the sliding door 26 to close and lock to the existing sliding door frame 12, and a closed position adjacent to the sliding door 26. The swing-away frame member 30 may be adapted to pivot into or out of the building structure 18, to suit existing conditions, or to suit user preference. Preferably, the swing away frame member pivots into the building structure 18.

When the swing-away pet door apparatus 10 is adapted for use on existing sliding doors 26 of different heights, a bracket extension 60 is preferably used to adjust the height of the swing-away frame member 30 to suit the height of the door frame member 12. A door stop face plate 64 may also be used to adjust the height of the door stop face plate 46 to suit the height of the upper track portion 24 of the existing door frame member 12.

The sliding door 26 may be slidably moved between an open position, allowing passage between the sliding door 26 and the swing-away frame member 30, and a closed position, adjacent to the swing-away frame member 30 which restricts access through the sliding door 26. Preferably, the sliding door 26 may be securely locked by a suitable locking means 44 to the swing-away frame member 30, when the swing-away frame member 30 is in the closed position.

One advantage to the swing away pet door disclosed herein, is the ease of cleaning a sliding door having a glass window. A stationary pet door limits the closing of the sliding door, resulting in a portion of the glass located in the sliding door that cannot be cleaned without removal of the stationary pet door. The swing-away pet door apparatus disclosed herein, enables the user to swing the pet door out of the way, allowing the sliding door to be fully closed, which enables the user to easily clean the entire sliding glass door window area, without removal of the pet door as required by the prior art devices.

A bracket extension 60 may be adapted for securement to the upper end 44 of the swing-away frame member 30 to provide adjustment for varying heights of the sliding glass door frame 12. Preferably, the bracket 60 is an inverted U-shaped configuration, which is slidably received upon the upper end 44 of the swing-away frame member 30, and secured thereto by any known fastening means, such as a screw secured through a slotted aperture 31 in the bracket 54 into an aligned aperture in the swing-away frame member 30.

The swing-away frame member 30 may be installed on site with the use of a screw driver (not shown). The elastomeric sealing flange member 46 is preferably adhesively secured to the door flange, providing an air tight seal therebetween. The swing-away frame member 30 is preferably adapted to open inside the structure. However, it is within the scope of this disclosure, to also have the swing away frame member 30 open towards the outside of the structure, to suit the dynamics of the building structure 18, or to suit user preference.

The swing-away frame member 30 is preferably constructed of extruded aluminum or plastic materials. Where plastic materials are used, ABS thermoplastic material is preferred. Preferably, the swing-away frame member 30 is provided with a mill, bronze or white finish to suit most applications. Alternately, the swing-away frame member 30 may be made of wood, fiberglass or other known building materials, which may be painted or stained on site, without departing from the scope of this disclosure or of the following claims.

Figure 6:
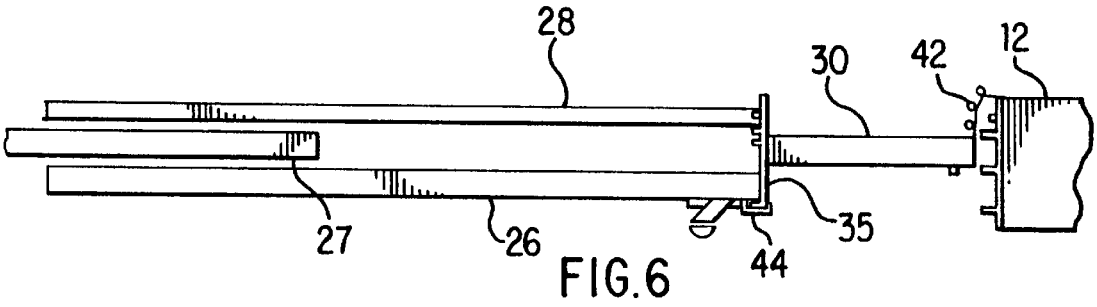
FIG. 6 is a cut-away view taken along lines 2—2 in FIG. 1, showing the door stop face plate with multi-position hinge located at the end of the swing-away pet door, with both the screen door and the sliding glass door abutted against the door stop face plate.
Figure 7:
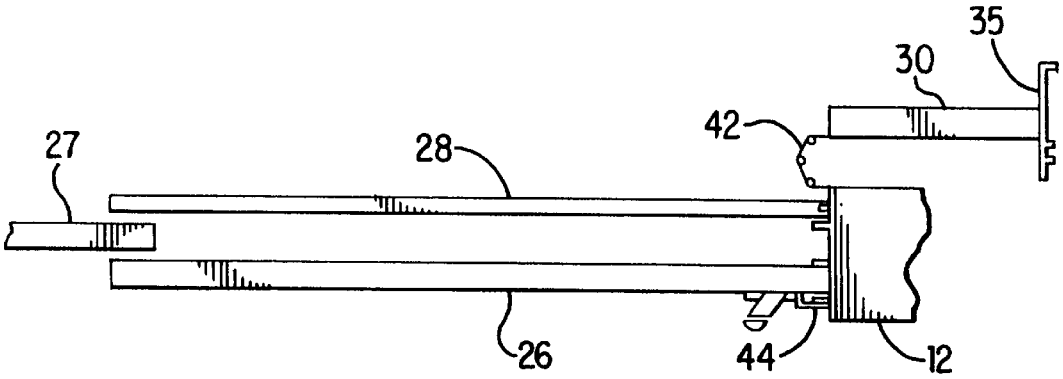
FIG. 7 is a cut-away view taken along lines 2—2 in FIG. 1, showing the use of a multi-position hinge to pivot the swing-away door approximately 180 degrees from its closed position, allowing full access through the sliding glass door and the screen door.
Figure 5B:
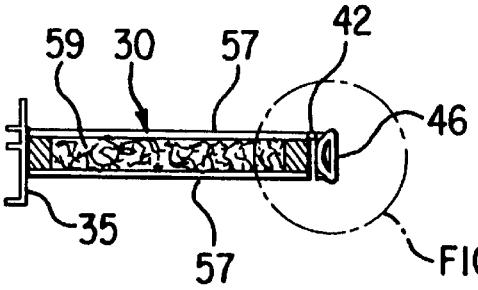
FIGS. 5A–5C are views of the swing-away pet door assembly, prior to installation to a sliding glass door frame.
Figure 5A:
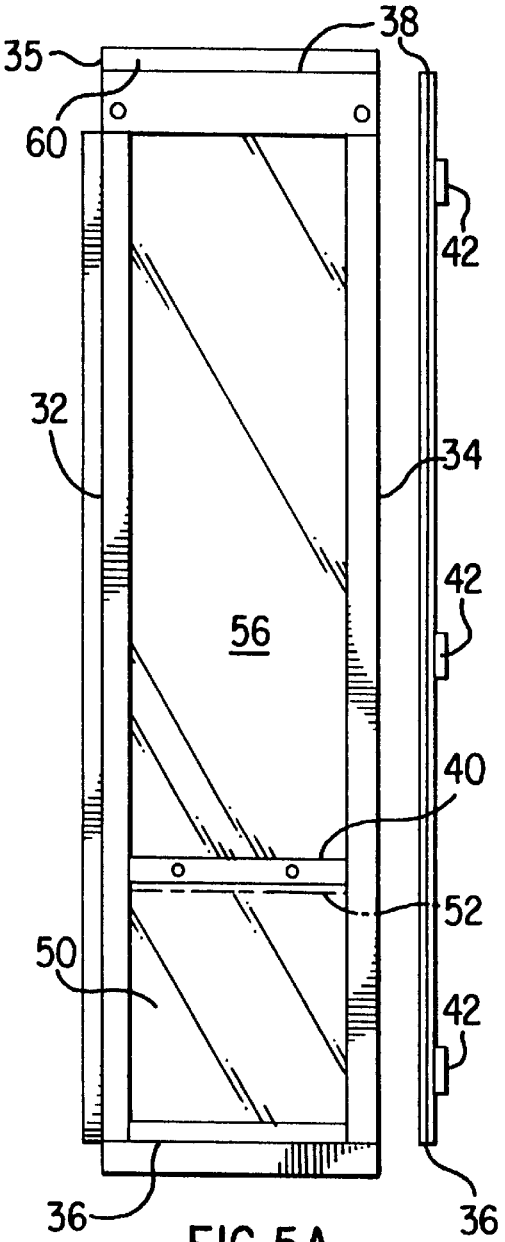
Figure 5C:
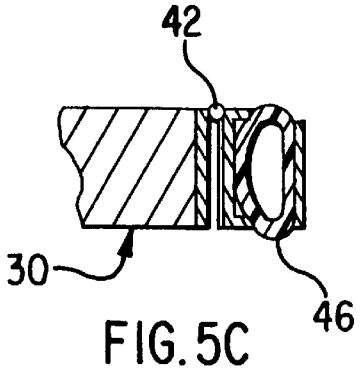
Figure 8:
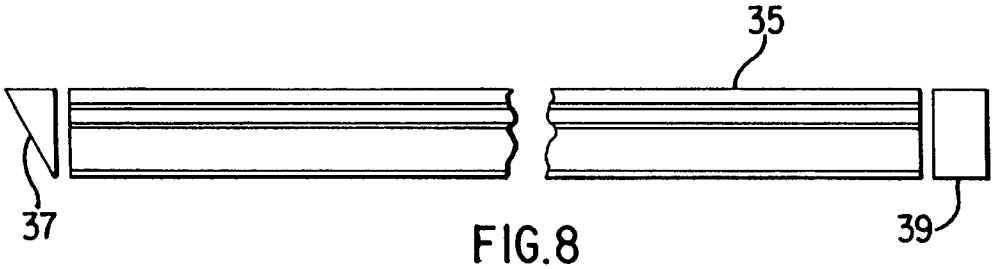
FIG. 8 is a detail view of a door stop face plate and adjustment plates, to adjust the height of the striker plate, for use with different size door openings.
Figure 9:
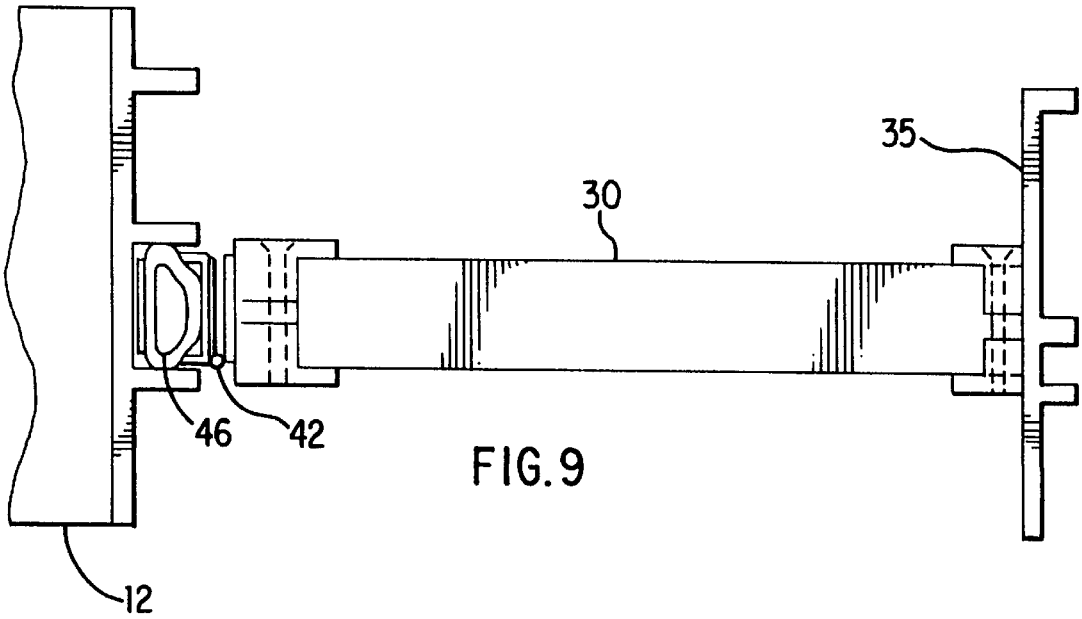
FIG. 9 is a cutaway view of a conversion kit showing conversion flanges attached to an existing stationary type door.
Figure 10:
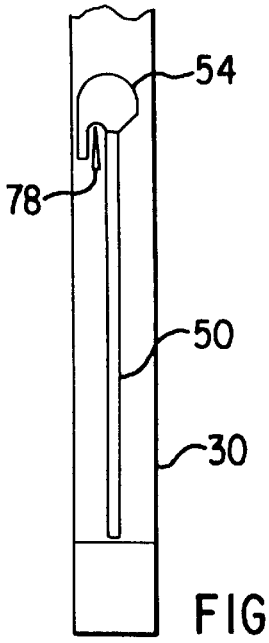
FIG. 10 is side view of the pet door, wherein a pet door flap is connected to a pivotal counter weight for ease of opening the pet door flap.
Figure 11:
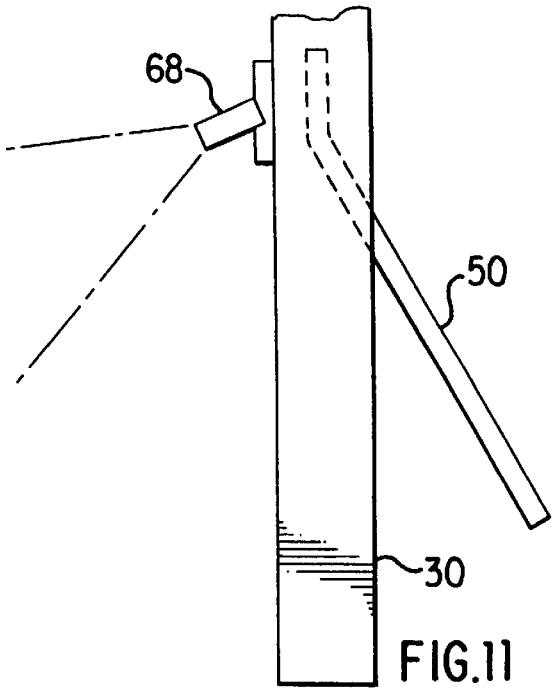
FIG. 11 is a side view of the pet door, wherein an infra-red or optical sensor is utilized to actuate the flap drive motor to power the flap open for training and ease of use.

The swing-away pet door apparatus 10 disclosed herein may be manufactured as component parts as shown in FIG. 6, and sold as a kit for installation in new or existing sliding door structures. Alternately, the swing-away pet door apparatus 10 disclosed herein, may also be fabricated and sold as part of a pre-assembled sliding door assembly. A conversion kit will provide a means to convert existing pet doors to the swing-away pet door apparatus disclosed in this specification.

Figure 13:
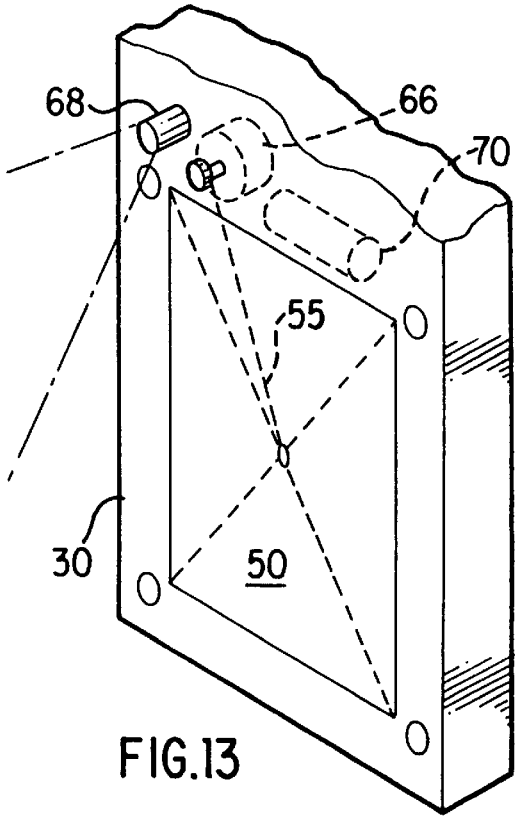
FIG. 13 is a detail view of the pet door, wherein an infra-red or optical sensor actuates a motor to pull the center of the pet door, to stretch the opening to a desired size.

As shown in FIG. 13, the pet door 50 may alternately be opened by a cable 55 attached to the center of a flexible pet door 50 closure. When actuated, the cable will pull on the flexible pet door 50 closure to open the flexible pet door 50 closure to a desired size. The flexible pet door 50 closure may be weighted 54 on the bottom, to close the flexible pet door 50 closure when the cable 55 is released. A motor 66 may be used to selectively wind or unwind the cable 55 to selectively open and close the flexible pet door 50 closure.

As shown in FIG. 14, the swing away pet door apparatus 10 may be adapted with a flea spray means 72, for spraying a fluid, such as a liquid, mist or powder flea spray upon the pet as it passes through the pet door 50. The flea spray means 72 is preferably adapted with a cyclic or timing control means 74 to selectively control the actuation of the flea spray means 72, such as once a day, or every selected number of times the pet passes through the pet door 50, etc. The timing control means 74 is preferably adapted to adjustably control the timing of the flea spray means 72, in accordance with changing seasons, temperature, pet activity, etc.

As shown in FIG. 15, the pet door 50 may be adapted with a spring loaded pet door closure means 51, to aid in closing the pet door 50 after a pet passes therethrough. As previously noted, actuation of the pet door 50 may be controlled by a suitable sensing means 68, such as an infra-red, optical or motion sensor.

Figure 16:
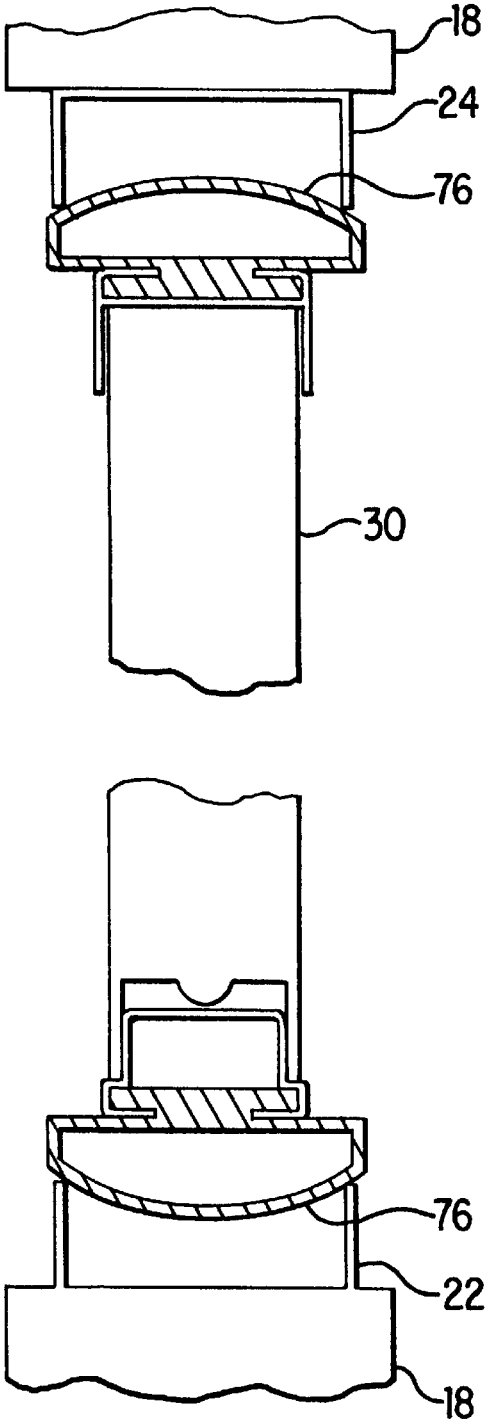
FIG. 16 is an enlarged view of a mushroom seal attached to the top and bottom of the pet door.

FIG. 16 is a cross sectional view of a mushroom seal 76 attached to the top and/or bottom of the pet door 50, to improve the sealing characteristics of the pet door 50.

Figure 17:
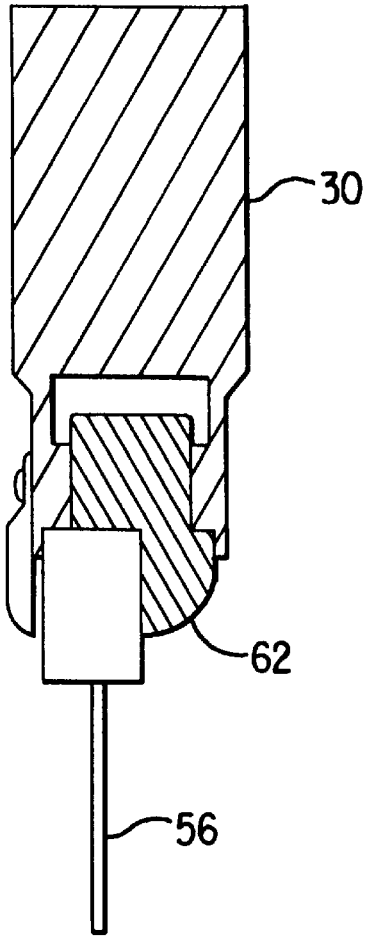
FIG. 17 is an enlarged cross-sectional view of an adaptor seal for use with replaceable insert windows, screens, etc.

FIG. 17 shows the use of adapter seals for replaceable insert windows, screen, etc. Adapter seals limit the passage of air and bugs between the insert windows or screens.

While a specific embodiment of the invention has been shown and described herein for purposes of illustration, the protection afforded by any patent issuing hereon is not strictly limited to the disclosed embodiment; but rather extends to all structures and arrangements which fall fairly within the scope of claims which are to be appended hereto.

What is claimed is:

1. A swing away pet door apparatus, for securement to a sliding door frame member having a sliding door slidably received with said sliding door frame member, which comprises:

a) a pet door frame having a first upright portion, a second upright portion, a lower side portion extending between and connected to the first and second upright portions, an upper side portion extending between and connected to the first and second upright portions and at least one cross brace portion extending between and connected to the first and second upright portions;

b) an upright hinge pivotally connected between a selected one of the first and second upright portions and an elastomeric sealing flange member; the elastomeric sealing flange member sized to be secured to an existing sliding door upright frame member, the pet door frame movable between open and closed positions about the upright hinge;

c) a pet door movably positioned between the first and second upright portions, the lower side portion and one cross brace portion of the pet door frame, the pet door positioned to provide ingress and egress to a pet there-through; and the pet door frame is secured to an existing sliding door frame to abut the existing sliding door when the pet door frame is in the closed pet door frame position, and the pet door frame may be pivoted about said hinge to swing clear of the sliding door in an open pet door frame position, enabling the existing sliding door to be closed and locked against the sliding door frame when the pet door frame is not being used, while enabling substantially full access between the sliding door and the sliding door frame when the pet door frame is in an open position.

2. The swing away pet door apparatus of claim 1, wherein the swing away pet door apparatus includes a locking member for securing one end of the existing sliding door to the pet door frame, when the pet door frame is in a closed position.

3. The swing away pet door apparatus of claim 1, wherein a screen member extends between the first and second upright portions, at least one cross brace portion, and the top portion.

4. The swing away pet door apparatus of claim 1, wherein a transparent window is secured between the first and second upright portions, at least one cross brace portion and the top portion.

5. The swing away pet door apparatus of claim 1, wherein a stained glass window is secured between the first and second upright portions, at least one cross brace portion and the top portion.

6. The swing away pet door apparatus of claim 1, wherein at least one panel is secured to the first and second upright portions, to at least one cross brace portion, and to the top portion.

7. The swing away pet door apparatus of claim 6, wherein said at least one panel is two opposing panels secured in spaced relation between the first and second upright portions, at least one cross brace portion, and the top portion, and wherein insulation is placed between the opposing panels.

8. The swing away pet door apparatus of claim 1, wherein the pet door is pivotally secured to the cross brace portion with a pet door hinge.

9. The swing away pet door apparatus of claim 1, wherein the pet door is vertically biased with a pet door hinge secured to a selected one of the first upright portion and the second upright portion to provide ingress and egress to the pet through the pet door.

10. The swing away pet door apparatus of claim 1, wherein the pet door is horizontally biased to provide ingress and egress to the pet through the pet door.

11. The swing away pet door apparatus of claim 1, wherein a sensor selectively actuates a motor coupled to the pet door to bias the pet door open as the pet approaches the pet door.

12. The swing away pet door apparatus of claim 11, wherein the sensor is selected to be one of: an infra-red sensor, an optical sensor, and a motion sensor.

13. The swing away pet door apparatus of claim 11, wherein the motor is a direct current motor, powered by a battery source.

14. The swing away pet door apparatus of claim 11, wherein the motor is powered by an alternating current from a remote alternating current source.

15. The swing away pet door apparatus of claim 1, wherein a mushroom seal extends across the top and bottom portions of the pet door.

16. The swing away pet door apparatus of claim 1, wherein the upright hinge is a continuous hinge extending substantially the height of the pet door frame.

17. The swing away pet door apparatus of claim 1, wherein a fleas spray apparatus is mounted in proximity to the pet door, and the flea spray apparatus is actuated by a timer control apparatus responsive to movement of a pet through a pet door, and wherein the flea spray apparatus is positioned to deposit flea spray fluid upon the pet as the pet passes through the pet door apparatus.

18. The swing away pet door apparatus of claim 1, wherein the pet door is sized to be from five inches to twelve inches in width, and from eight inches to eighteen inches in height.

19. The swing away pet door apparatus of claim 1, wherein the pet door is made of a flexible material, with a suitable cable secured thereto, and the cable is pulled to move the pet door into an open position, and the cable is released to move the pet door into a closed position.

20. A swing away pet door apparatus, for securement to a sliding door frame member having a sliding door slidably mounted within the sliding door frame, which comprises:

a) a pet door frame having a first upright portion, a second upright portion, a lower side portion extending between and connected to the first and second upright portions, an upper side portion extending between and connected to the first and second upright portions and at least one cross brace portion extending between and connected to the first and second upright portions, with at least one panel secured to the first upright portion, the second upright portion, one of the cross brace portions, and the upper side portion;

b) a continuous upright hinge pivotally connected between a selected one of the first and second upright portions and an elastomeric sealing flange member; the elastomeric sealing flange member sized to be secured along substantially the height of an existing sliding door upright frame member, the pet door frame movable between open and closed positions about the continuous upright hinge;

c) a pet door movably positioned between the first and second upright portions, the lower side portion and the cross brace portion of the pet door frame, the pet door vertically biased to provide ingress and egress to a pet there-through; and the pet door frame is secured to an existing sliding door frame member to abut the existing sliding door when the pet door frame is in the closed pet door frame position, and the pet door frame is pivoted about said upright hinge to swing clear of the sliding door in an open pet door frame position, enabling the existing sliding door to be closed and locked with an existing locking apparatus against the existing sliding door frame when the pet door frame is not being used, and to provide substantially full access through the open portion of the sliding door.

21. The swing away pet door apparatus of claim 20, wherein the pet door is horizontally biased to provide ingress and egress to a pet through the pet door.

22. A swing away pet door apparatus, for securement to a sliding door frame member having a sliding door slidably mounted within the sliding door frame, which comprises:

a) a pet door frame having a first upright portion, a second upright portion, a lower side portion extending between and connected to the first and second upright portions, an upper side portion extending between and connected to the first and second upright portions, and at least one cross brace portion extending between and connected to the first and second upright portions;

b) a hinge pivotally connected between a selected one of the first and second upright portions; and an elastomeric sealing flange member; the elastomeric sealing flange member sized to be secured to an existing sliding door upright frame member, the pet door frame movable between open and closed positions about the hinge;

c) a pet door movably positioned between the first and second upright portions, the lower side portion and one cross brace portion of the pet door frame, the pet door positioned to provide ingress and egress to a pet there-through;

d) a sensor for sensing the presence of a pet in proximity to the pet door;

e) an actuating apparatus for selectively opening and closing the pet door in response to the presence of a pet in proximity to the pet door; and the pet door frame is secured to an existing sliding door frame to abut the existing sliding door when the pet door frame is in the closed pet door frame position, and the pet door frame is pivoted about said hinge to swing clear of the sliding door in an open pet door frame position, enabling the existing sliding door to be closed and locked against the sliding door frame when the pet door frame is not being used, while providing substantially fall access between the opened sliding door and the existing door frame.

23. The swing away pet door apparatus of claim 22, wherein the sensor is one of: an infra-red sensor, an optical sensor, and a motion sensor.

24. The swing away pet door apparatus of claim 22, wherein the actuating apparatus is a motor coupled to the pet door, to selectively raise and lower the pet door in response to the sensor.

25. The swing away pet door apparatus of claim 22, wherein a mushroom seal extends across the top and bottom portions of the pet door.

26. The swing away pet door apparatus of claim 22, wherein the swing away pet door apparatus includes a locking apparatus for securing one end of an existing sliding door to the pet door frame, when the pet door frame is pivoted about the hinge into a closed position in alignment with the sliding door.

* * * * *